United States Patent [19]

Childers et al.

[11] Patent Number: 4,775,353

[45] Date of Patent: Oct. 4, 1988

[54] SPIRAL COIN-QUEUEING HEAD FOR HIGH-SPEED COIN-SORTING AND COUNTING APPARATUS

[75] Inventors: Roger K. Childers, Tigard; Kenneth L. Buchanan, Troutdale; Russel Darmour, II, Portland, all of Oreg.

[73] Assignee: Childers Corporation, Wilsonville, Oreg.

[21] Appl. No.: 788,396

[22] Filed: Oct. 17, 1985

[51] Int. Cl.[4] ..... G07D 3/00

[52] U.S. Cl. ..... 453/6

[58] Field of Search ..... 133/3 A; 453/6, 10

[56] References Cited

U.S. PATENT DOCUMENTS

| | | | |
|---|---|---|---|
| 2,906,276 | 9/1959 | Blanchette et al. . | |
| 2,977,961 | 4/1961 | Buchholz et al. . | |
| 3,795,252 | 3/1974 | Black | 133/3 A |
| 3,998,237 | 12/1976 | Kressin et al. | 133/3 A |
| 4,086,928 | 5/1978 | Ristvedt et al. | 133/3 A |
| 4,098,280 | 7/1978 | Ristvedt, et al. | 133/3 A |
| 4,105,105 | 8/1978 | Braum | 194/319 |
| 4,111,216 | 9/1978 | Brisebarre | 133/3 A |
| 4,234,003 | 11/1980 | Ristvedt et al. | 133/3 A |
| 4,444,212 | 4/1984 | Ristvedt et al. | 133/3 A |
| 4,506,685 | 3/1985 | Childers et al. | 133/3 A |
| 4,531,531 | 7/1985 | Johnson et al. | 133/3 A |
| 4,543,969 | 10/1985 | Rasmussen | 133/3 A |
| 4,564,037 | 1/1986 | Childers | 133/3 A |

*Primary Examiner*—F. J. Bartuska

*Attorney, Agent, or Firm*—Seed and Berry

[57] ABSTRACT

A coin-queueing head for use in a high-speed coin-sorting and counting apparatus is provided using a spiral coin processing channel. Coins are fed from a central loading area through an infeed opening into an infeed area having a height permitting unrestricted outward travel of the coins to a peripheral limit having a generally helical shape. The coins are then fed into a coin-processing channel having a first portion for partially separating face-stacked coins. The coins then pass to a second ramped channel portion providing a gradual depessing of the coins and a sudden release into a third channel portion. An inwardly positioned camming lobe and an outwardly positioned expanded area are provided to facilitate lateral separation of the coins upon their release from the second channel portion. The trailing end portion of the third channel portion has a height to relieve the coins of all restriction and the peripheral limit is sloped upward to provide a smooth transition of the coins from their helical path to the circumferential peripheral rim of the disc. Recirculation is provided into the infeed area of coins positioned too far inward at the entry into the first channel portion.

51 Claims, 4 Drawing Sheets

SPIRAL COIN-QUEUEING HEAD FOR HIGH-SPEED COIN-SORTING AND COUNTING APPARATUS

DESCRIPTION

1. Technical Field

This invention relates to coin-sorting and counting apparatus, and more particularly, to coin-queueing heads which align coins for subsequent sorting and counting.

2. Background Art

The large and increasing volume of coin-operated machines makes the rapid and accurate sorting and counting of coins an economic necessity. Vending machines, metropolitan area transit systems, pay telephones, and other coin-operated devices have expanded the use of coins and the requirements for economical counting of coins beyond all expectations.

Several machines have been designed for this purpose, exemplified by those disclosed in U.S. Pat. Nos. 2,906,276 (to Blanchette, et al.), 3,795,252 (to Black), 4,086,928 (to Ristvedt, et al.), 4,111,216 (to Brisebarre), and 4,506,685 (to Childers, et al.). Each has coin-sorting by centrifugal force according to denomination, counting of the individual denominations by some type of sensing means, and storing and display of the information about the counts during the process. Each also provides for storing and removal of the coins after counting.

In such machines, the centrifugal force is imparted to the coins by the rotation of a disc onto which coins are delivered in bulk, usually through a central hopper. The coins are then guided to deliver them to a position adjacent a peripheral retaining rim of the disc. At the peripheral rim, the coins are selectively engaged according to denomination by one of a plurality of engagement means such as wheels, blades, cams or the like positioned around the peripheral rim. The engagement means depresses or lifts the coins to free them from the peripheral rim of the disc and allows the centrifugal force to hurl them through the air to one of a plurality of corresponding catching devices. The coins are then diverted to appropriate collecting bags. Alternatively, the engagement means may be the slots or indentations shown in U.S. Pat. Nos. 4,095,280 and 4,234,003 (Ristvedt, et al.).

The sorting is typically accomplished by the engagement means based upon the differences in diameter of the various denominations of coins being processed. Conventional engagement means require the coins to be in a single-layer, single-file row at the peripheral rim to avoid malfunctioning of the machine and to insure a proper count. The count is usually made by photoelectric means which sense the number of coins entering each catching device.

The speed at which such machines can sort and count coins is dependent in large part on the ability of the machine to supply coins from the central area of the disc to the peripheral rim. Since the coins are dumped in bulk into the hopper with random orientation, it becomes critical that the coins be properly oriented, arranged in a single layer, and positioned in a single file at the peripheral rim of the disc for engagement by the engagement means. If the process of orienting, arranging and positioning the coins is not accomplished efficiently, the supply of the coins to the engagement means will not be continuous and at a sufficient rate, and the operating speed of the machine will be slowed down. Similarly, if the coins get jammed and their flow blocked to the peripheral rim, not only may the flow of coins to the engagement means be non-continuous, but the jam may cause a drag to be placed on the rotating disc which will decrease its rotational speed and affect the operating speed of the machine. A sufficiently large jam of coins may even stall the rotating disc, requiring disassembly of the machine to clear the jam. In any event, a jam may result in an improper count of coins with some remaining in the machine after the counting is believed complete, and in tearing of the flexible pad covering the disc.

In the past, may of these problems have been handled with the use of guides arranged on a head which is positioned immediately above the rotating disc. Such guides are shown in the Ristvedt, et al., Blanchette, et guides are shown in the Ristvedt, et al., Blanchette, et al., and Childers, et al., patents. The problems of removing one coin from a pair of vertically or face stacked coins was partially solved in the Brisebarre and Black patents by the use of a ring or strip which presents an edge wall spaced above the rotating disc to knock off a top coin of a pair of stacked coins. The edge wall is spaced far enough above the rotating disc to let the thickest single coin pass thereunder, but yet low enough to allow only one of the thinnest coins to pass under the edge wall at a time. In other words, a vertical stack of two or more of the thinnest coins will not pass under the edge wall and the top coins will be knocked off the stack.

This presupposes that the height of a stack of two of the thinnest coins being handled by the machine is appreciably larger than the thickness of the thickest coin being processed by the machine. If the stack of the thinnest coins is equal to or less than the thickness of the tow thin coins and fail to knock off the top coin. With United States coins currently in circulation, a stack of two dimes is approximately equal to the thickness of a half-dollar. As such, it becomes difficult to avoid having a pair of stacked dimes reach the engagement means, and care must be taken to avoid processing a mixture of coins having dimes and half-dollars. The same problems are encountered when processing coinage of other nations. This problem was solved by the Childers, et al. patent using an arrangement which included an edge wall positioned transverse to the coin flow and a coin depressing ramp.

The use of any edge wall, however, causes certain problems. Coins which are not laying completely flat immediately prior to passing under the edge wall as a result of machine vibration or otherwise, may undesirably be engaged by the edge wall. The blocked coin is then diverted away and recirculated through the machine. This tends to slow up the machine and disrupt its smooth operation. Another problem is that an abrupt edge wall causes abrasion of the coins. This causes increase drag on the head and the coins tend to wear and metal dust is produced. To eliminate the accumulation of the dust, openings in the peripheral rim of the disc may be provided to allow the dust to be thrown outward free of the disc so as not accumulate at the rim as the disc rotated. This increases the cost of manufacturing the disc and periodic cleaning of the dust is required anyway, resulted in machine down time.

An additional problem concerns the degree of precision required in setting the height of the head above the disc so that the guides and the edge wall will be at the necessary distance from the pad. By requiring precision, setting up a head becomes somewhat difficult and time consuming. Moreover, since the heads previously used had to be relatively close to the pad, entry of coins under the head was made difficult and their outward movement once under the head was somewhat restricted. This had an impact on the speed and efficiency with which coins were processed.

Eliminating horizontally or edge stacked coins is another problem any head must handle. If edge stacked coins reach the peripheral rim of the disc for engagement by the engagement means, inaccurate counts will occur, or a malfunction of the machine will result. While guides may be positioned on the head to isolate, trap and recirculate many of the edge stacked coins, this results in slowing up the operational speed of the machine.

Although heads have been designed that provide the sorting function, and eliminate at least many of the face stacked and edge stacked coins, the speed and reliability of these machines is less than desired. Furthermore, the heads for these machines tend to be difficult and expensive to manufacture, and difficult and time consuming to set up, and to require frequent maintenance and readjustment, and wear out too quickly. Many of the machines can only handle a limited number of coin types at the same time, and cannot process coins with significant differences in size.

It will therefore be appreciated that there has been a significant need for a queueing head for a high-speed coin-sorting and counting apparatus which is able to properly orient, arrange into a single layer, and position in single file coins of various thicknesses and diameters in an improved manner. Preferably, the head should be able to handle a variety of as many as nine coins in a reliable manner. The present invention fulfills this need and provides other related advantages.

DISCLOSURE OF THE INVENTION

The present invention resides in a coin-queueing apparatus ahs head thereor. The head is positionable in a spaced relationship over a rotating flexible surface to process randomly oriented coins and place them in a single layer, single file.

The rotating flexible surface has a horizontally oriented central portion and an upwardly outward slanted annular portion thereabout an upwardly extending peripheral rim extends above the flexible surface and around the annular disc portion for engaging the ouward edge of coins. Coin engaging wheels sort the coins by denomination.

The head includes a central opening for receiving the randomly oriented coins, and a first peripheral limit extending generally circumferentially about the central opening to limit outward travel of the coins from the central opening and to define an infeed opening for passage of the coins therethrough. An infeed area is provided under the head for receiving the coins in the central area through the infeed opening, and has a height sufficient to permit substantially unrestricted, outward travel of the coins. A second peripheral limit is positioned across from and outward of the infeed opening to limit the outward travel of the nonstacked coins in the infeed area. A coin-processing channel is provided under the head for receiving the coins from the infeed area.

The channel extends in a generally outward spiral from the infeed area to an outfeed opening at the perimeter of the head. The channel has a width greater than the diameter of the largest diameter coin of the coins being processed and includes a generally outward spiraling third peripheral limit defining an outward wall of the channel to limit outward travel of the coins in the channel. The channel has first, second and third lengthwise portions.

The first channel portion receives the coins from the infeed area and has a height sufficient to partially depress any double face-stacked coins into the flexible surface in order to apply drag force on the upper coin of the double-stacked coins for at least partial lateral separation thereof while still permitting unrestricted outward travel of the non-stacked coins. The first channel portion has a height to partially capture at least certain of the double-stacked coins to substantially maintain their radial position as they travel the length of the first channel portion.

The second channel portion receives the coins from the first channel portion and has a height sloping downward toward the flexible surface in the direction of travel of the coins from substantially the height of the first channel portion to a reduced height sufficiently close to the flexible surface to depress any of the double-stacked coins into the flexible surface. This applies an increased drag force on the upper coin of the double-stacked coins greater than applied in the first channel portion to accomplish to least partial lateral separation thereof and to substantially maintain the radial position of the double-stacked coins as they travel the length of the second channel portion. The second channel portion depresses the double-stacked coins sufficiently to cause relative rotation between the coins of the stack and thereby facilitate their lateral separation. The double-stack coins and any coins in proximity therewith having a substantially similar height are depressed sufficiently into the flexible surface to prevent the proximity from reducing the drag force the flexible surface causes on the upper coin of the double-stacked coins enough to inhibit their partial lateral separation.

The third channel portion receives coins from the second channel portion and has a height sufficient to permit substantially unrestricted outward travel of the nonstacked coins. The transition distance between the reduced height portion of the second channel portion to the adjacent portion of the third channel portion is sufficiently short to provide a quick release of the double-stacked coins from under the reduced height portion. This allows the resiliency of the flexible surface to apply a propelling upward force thereon, tending to vertically separate the double-stacked coins. The third channel portion has an outwardly expanded area defined by an outwardly projecting lengthwise portion of the third peripheral limit positioned to permit increased outward movement of the partially separated double-stacked coins upon release thereof from under the reduced height portion of the second channel portion. This facilitates further lateral separation of the double-stacked coins.

A camming lobe projects from an inward wall of the third channel portion outward into the third channel portion to engage any inwardly positioned coins and apply an outwardly directed force thereon to facilitate their movement to the third peripheral limit. The camming lobe projects downwardly to the flexible surface sufficient to capture thereunder the lowest coin of certain double-stacked coins and to recirculate the coin while camming the upper coin of the double- stacked coins outward toward the third peripheral limit.

The third peripheral limit extending along the third channel portion includes a beveled first portion to cause rotation of the coins and a second portion downstream therefrom without a bevel to permit coin travel without rotation.

A guide is provided inward of the second peripheral limit and adjacent to the entry of the second channel portion to capture thereunder coins positioned inward from the second peripheral limit and to recirculate them back into the infeed area at a position inward of the second peripheral limit.

At an outfeed area of the third channel portion the third peripheral limit is upwardly sloping away from the flexible surface in the direction of travel of the coins to permit gradual outward travel of the coins from the helical path traveled in the third channel portion to a substantially circular path before exiting the outfeed opening.

In a preferred embodiment of the invention, the infeed area and the coin processing channel are oriented substantially horizontally, with the third channel portion having an upwardly and outwardly slanted outfeed area adjacent to the outfeed opening to place the coins in an upwardly slanted attitude at the perimeter of the rotating flexible surface for exit from under the head for subsequent sorting.

Other features and advantages of the invention will become apparent from the following detailed description, taken in conjunction with the accompanying drawings.

BEST MODE FOR CARRYING OUT THE INVENTION

Figure 1:
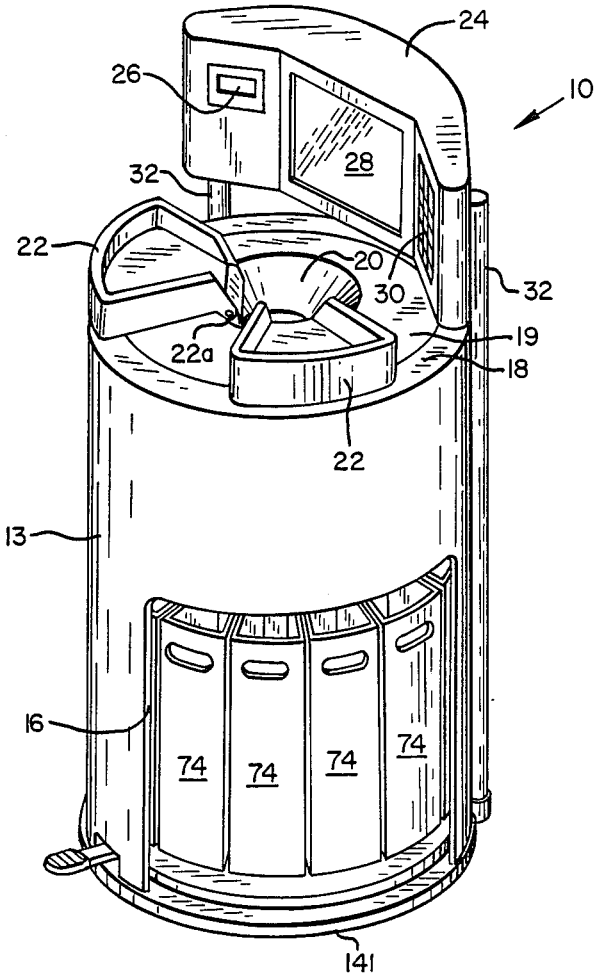
FIG. 1 is an isometric frontal view of a coin-sorting and counting apparatus, embodying the improved coin-queueing head of the present invention.
Figure 2:
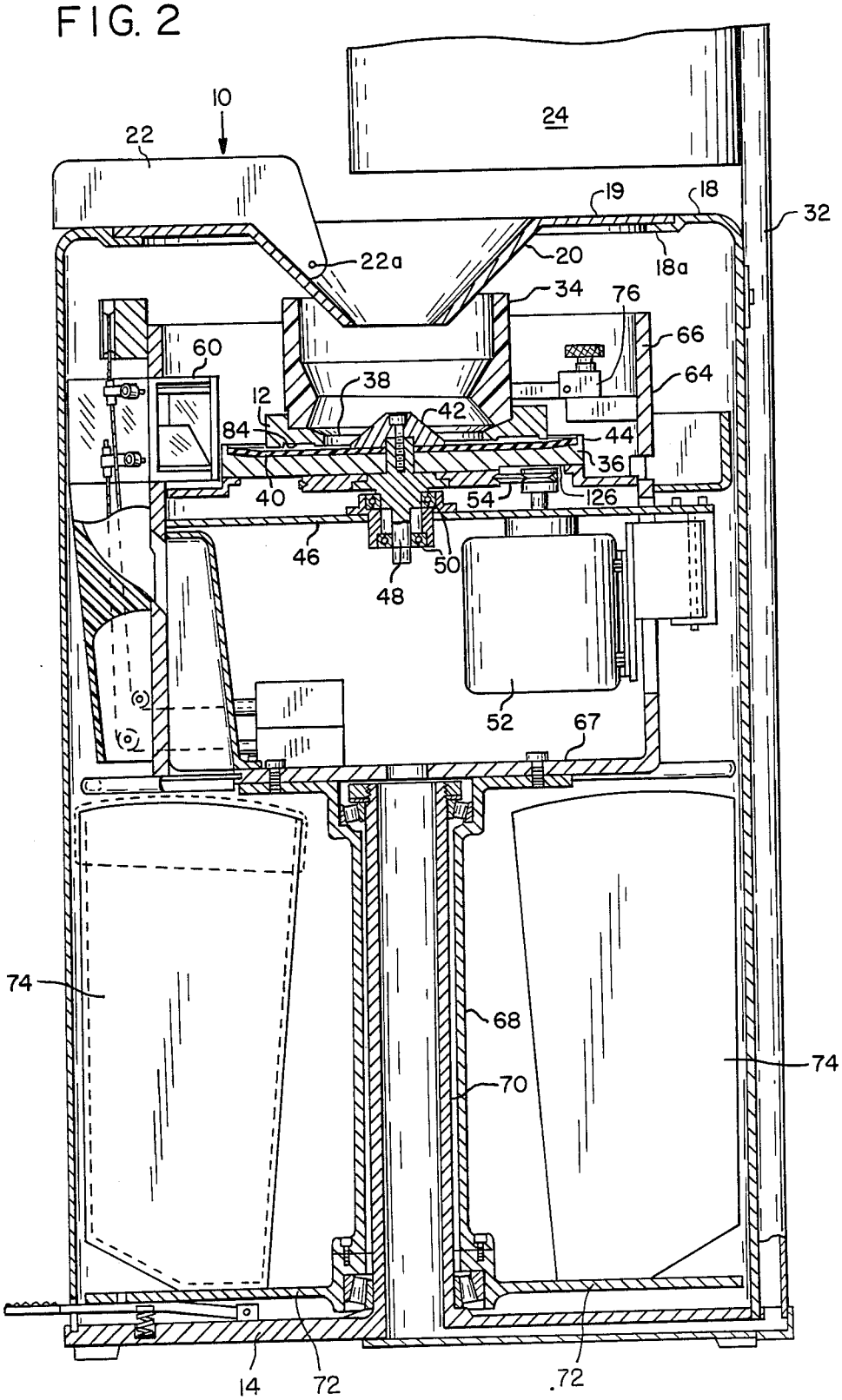
FIG. 2 is an enlarged, fragmentary, cross-sectional view of the apparatus shown in FIG. 1.

As shown in the drawings for purposes of illustration, the present invention is embodied in a high-speed coin-sorting and counting apparatus, indicated generally by reference numeral 10. More specifically, the present invention is embodied in an improved coin-queueing head 12 for such an apparatus. As best shown in FIGS. 1 and 2, the coin-sorting and counting apparatus 10 includes an outer cylindrical housing 13 mounted on a stationary circular base 14 with an opening 16 for access to the interior of the case. The case 13 had an annular upper end wall 18 with an inner lip **18*a* to supportably hold a removable top assembly lid 19 having a central funnel 20 extending therethrough. Two generally wedge-shaped coin loading trays 22 are each hingedly attached to the funnel 20 by their open end for dumping of a batch of coins contained therein into the funnel. The coin-sorting and counting apparatus 10 further includes a control panel 24 with an alpha-numeric printer 26, a video display terminal 28, and a panel 30 containing illuminated signal lights, audible indicators, switches and a keyboard. The display panel 24 is mounted above the case 12 on a pair of poles 32 which are fixedly attached to the case 12 and to the stationary base 14**.

An undifferentiated mix of coins with random orientation comprising a batch of coins such as received from a particular vending machine, pay telephone, toll collecting booth or other source of coins can be placed in one of the loading trays 22, with another batch of coins being placed in the other loading tray and held in ready for subsequent processing. The loading tray 22 containing the batch of coins to be processed may be tilted to dump the coins into the funnel 20 by lifting the loading tray upward and pivoting the tray about a hinge 22a connected to the wall of the funnel.

Positioned below the funnel 20 is a hopper 34 to receive the batch of coins dumped from the loading tray 22 (see FIG. 2). The hopper 34 is rigidly attached to the queueing head 12 and extends upwardly therefrom. The queueing head 12 is mounted in spaced arrangement above a rotatable circular disc 36. The hopper 34 had a corkscrew inerior shape and coins dumped into the hopper are channeled into a central circular opening 38 in the queueing head 36 and deposited on the rotating disc 36. Centrifugal force is imparted to the coins by rotation of the disc 36.

The queueing head 12 is positioned above an upper surface of the disc 36 by a preselected amount, with a lower surface or face of the head facing toward the upper surface of the rotating disc. A resilient frictional pad 40 covers the disc 36 and defines the upper surface of the disc. The lower surface of the head 12 is a low friction surface, preferably made of a durable metal. A conical member 42 is fixedly attached to the disc 12, at its center below the central opening 38, to prevent coins from remaining in the center of the disc by avoiding the centrifugal force caused by rotation of the disc. The centrifugal force is necessary to move the coins from the central opening 38 to a peripheral rim 44 of the disc 36 for sorting by denomination. The peripheral rim 44 extends upwardly above the upper surface of the frictional pad 40. The disc 36 is rotatably mounted to a stationary plate 46 by a shaft 48 supported by a pair of frictionless roller bearings 50. A motor 52 drives the disc 36 through a belt 54. The belt 54 rides on a pulley 56 formed as an integral part of the disc 38, and rotates the disc.

Figure 3:
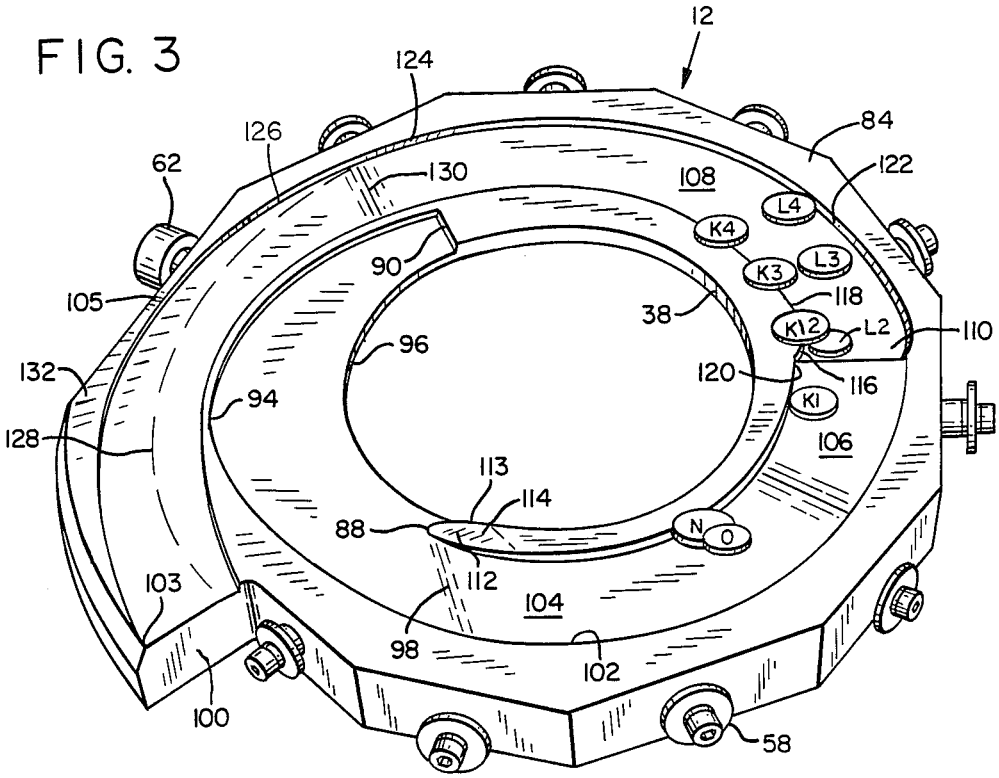
FIG. 3 is an enlarged isometric view of the underside of the coin-queueing head shown in FIG. 2 showing coins at various positions.
Figure 4:
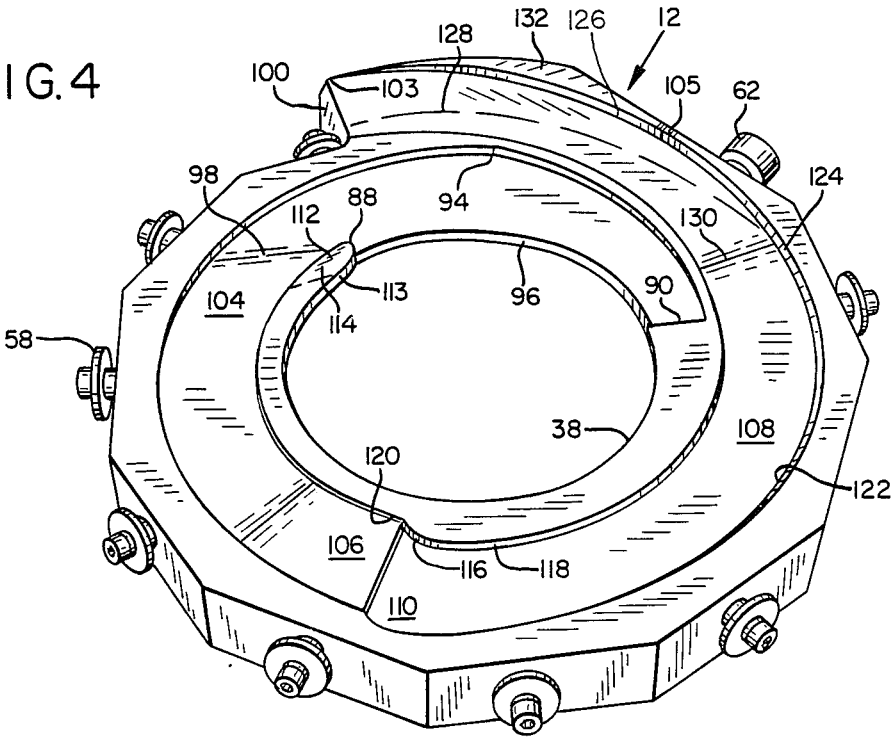
FIG. 4 is an enlarged, isometric view of the coin-queueing head of FIG. 3, rotated slightly to better illustrate a portion of the coin processing channel.

As the coins come through the central opening 38 of the head 12, they enter a loading area and encounter the centrifugal force generated by the rotating upper surface of the disc. The centrifugal force is imparted to the coins by their contact with the rotating resilient frictional pad 40. As viewed from above, the disc 36 rotates in the clockwise direction. Consequently, the coins tend to move in an outward spiral direction away from the loading area, eventually to enter into the space between the lower surface of the head and the upper surface of the disc. While the coins travel between the stationary head 12 and the rotating disc 36 under the urging of the centrifugal force, they are guided and separated to place them in a nonstacked, single-file queue by the time they reach the peripheral rim 44, whereat they are free of any control of the head, and coin-engaging wheels 58 (see FIGS. 3 and 4) sort the coins one at a time according to denomination, based on the diameter of the coins. In the presently preferred embodiment of the invention, when designed to handle United States coinage, the head 12 processes simultaneously pennies, nickels, dimes, quarters, half-dollars, and Susan B. Anthony dollar denomination coins, plus three sizes of tokens. In the past it has been difficult to process such a large number and wide variety of different size coins, and the ability to do so represents a significant improvement.

The coin-engaging wheels 58 comprise a plurality of coin-depressing wheels, rotatably mounted to the head 12 at spaced intervals along the outer perimeter of the head. In a conventional manner, the coin-engaging wheels 58 extend from the head by various distances corresponding to the diameter of the coin to be depressed, with the largest diameter coin being sorted first, then the next largest second, and so on. It should be understood that for purposes of the present description, the term "coins" is used for convenience to describe both money and tokens. It should also be understood that the coin-sorting and counting apparatus 10 of the preset invention is not limited to use with coin-depressing sorting wheels 58, and may be used in machines utilizing other means to sort the coins.

The coin-engaging wheel 58 depresses the radially inner edge of a coin into the resilient frictional pad 40, causing its outer edge to raise the coins to be hurled over the peripheral rim 44 of the disc 36 by the centrifugal force into a coin-catching device 60. The coins are counted by an electro-optical sensor (not shown) as they are traveling through the air. Should for some reason a coin or foreign object not be hurled from the disc 36, a last ejector wheel 62 is provided with a width sufficient to engage all diameter coins and foreign objects carried on the disc and cause them to be sufficiently pressed into the resilient frictional pad 40 and bounced upwardly therefrom by the resiliency of the pad that the centrifugal force will hurl them off the disc.

The coin-sorting and counting apparatus 10 has an inner frame 64 which is rotatably mounted to the stationary base 14 and provides the support structure for the disc 36, the head 12, the coin-catching devices 60 and the motor 52, as well as other components of the apparatus which will be described below. The frame 64 has a cylindrical sidewall 66 with a lower closed end 67 and tubular outer support post 68 rigidly attached to the underside of the closed end of the sidewall. The outer post 68 is rotatably mounted on a tubular inner support post 70 which is rigidly attached to the stationary base 14. A radially extending circular carrier plate 72 is rigidly attached to the lower end of the outer post 68 for carrying a plurality of coin-collecting receptacles 74, at least one for each denomination of coin being sorted and counted.

As shown in FIG. 2, a hinge assembly 76 is rigidly attached to the interior of the frame sidewall 66 at a position above the disc 36 and pivotally attaches the hopper 34 to the sidewall. As previously described, the queueing head 12 is rigidly attached to the hopper 34 and is supported thereby above the upper surface of the resilient frictional pad 40 carried by the disc 36. The vertical position of the head 12 above the upper surface is adjustable through two adjustable spacer bolts (not shown) forming part of the hinge assembly 76 and a third adjustable spacer bolt (not shown) positioned to a side of the head generally opposite the hinge assembly. The third adjustable spacer bolt is releasably attached to the interior of the frame sidewall 66. Upon release of the third spacer bolt, the combined head 12 and hopper 34 assembly may be rotated upward about the hinge assembly 76 to lift the head away from the disc 36 for inspection, repair, cleaning, and clearing of any obstructions which may occur.

The coin-catching devices 60 channel coins received in flight downward and have downwardly opening exit portions for the passage of the stream of coins into the respective coin-collecting receptacle 74 positioned directly therebelow on the carrier plate 72. A more complete description of the apparatus 10 with which the coin-queueing head 12 of the present invention is used may be found in a commonly owned U.S. patent application Ser. No. 658,534, filed Oct. 9, 1984 which is incorporated herein by reference.

Figure 5:
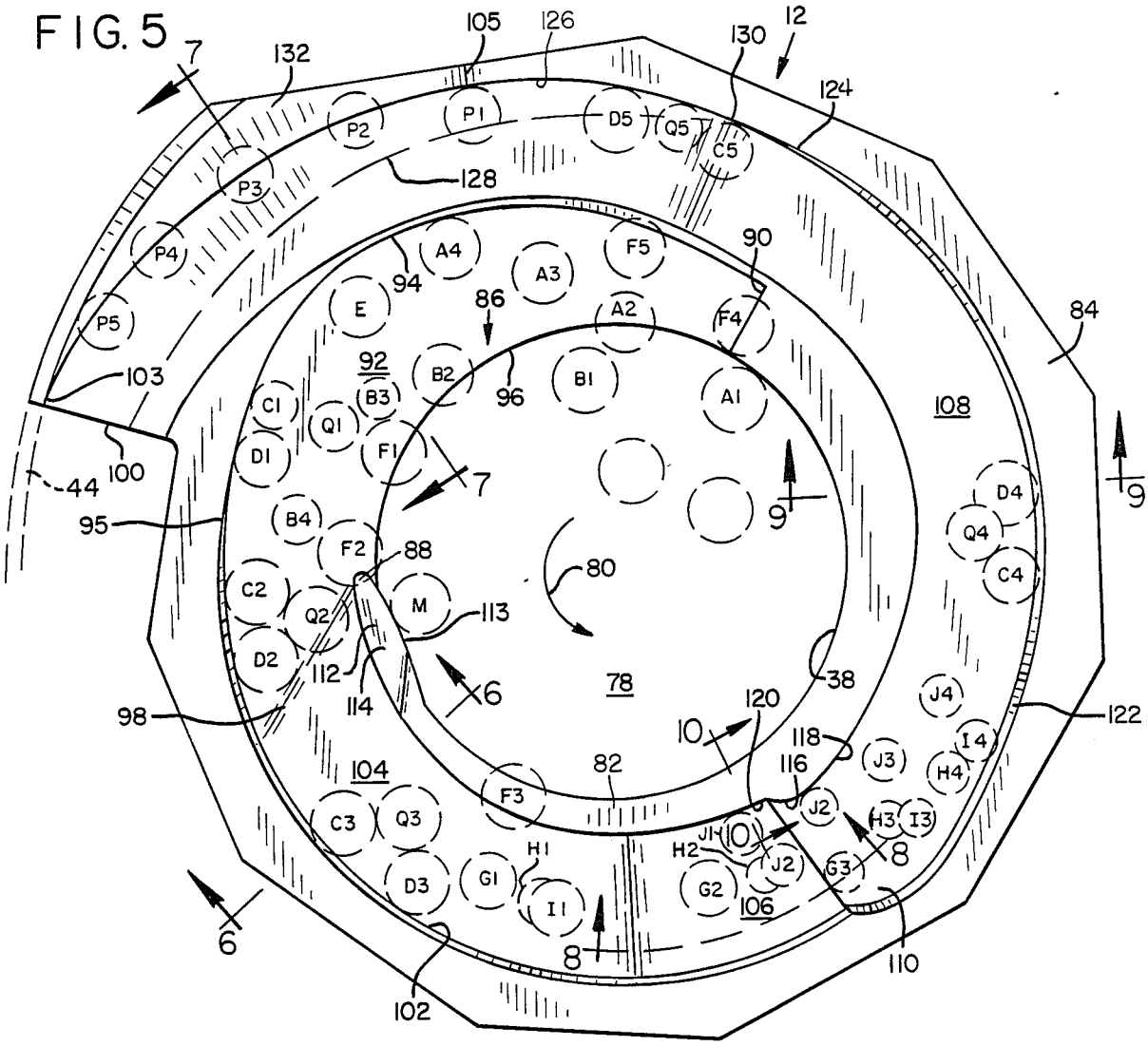
FIG. 5 is a plan view of the coin-queueing head of the present invention showing the underside of the coin-queueing head with coins sequentially shown at various positions to demonstrate the operation of the head.
Figure 6:
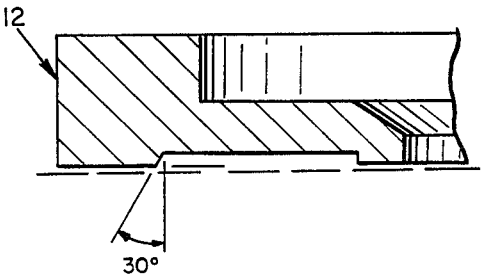
FIG. 6 is an enlarged, fragmentary, sectional view taken substantially along the line 6—6 of FIG. 5.
Figure 7:
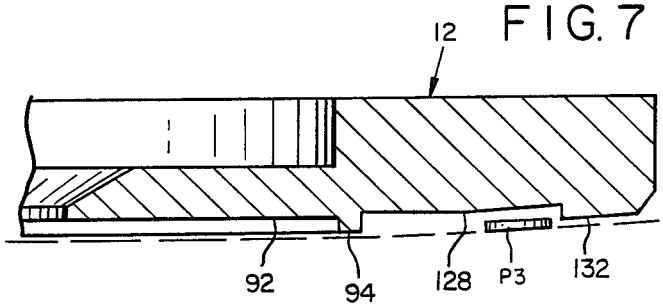
FIG. 7 is an enlarged, fragmentary, sectional view taken substantially along the line 7—7 of FIG. 5.

Turning now to FIG. 5, the lower surface or face of the queueing head 12 is shown. It is to be remembered that in the description which follows, based on FIG. 5, the viewer is facing upward and the rotating disc 36 (shown by phantom lines) is spaced slightly toward the viewer. In use, the queueing head 12 is positioned in a spaced relationship over the rotating upper surface of the resilient and flexible frictional pad 40 carried by the rotating disc 36.

As the randomly oriented coins come through the central circular opening 38 of the head 12 they enter a central loading area 78 and encounter the centrifugal force generated by the rotating upper surface of the resilient frictional pad 40. The centrifugal force is imparted to the coins by their contact with the frictional pad 40. The disc 36 rotates in the direction shown by the arrow 80 (the direction of rotation is counterclockwise since it is being viewed in FIG. 5 from below). Consequently, the coins tend to move in an outward spiral direction away from the loading area 78 and toward the space between the lower surface of the head 12 and the upper surface of the frictional pad 40. This is shown by the sequences of coins A1-A4, B1-B4 and F1-F2 in FIG. 5 which illustrates how the coins A, B and F move through their sequentially numbered positions.

The queueing head 12 has a first peripheral limit 82 attached to and projecting downward from a lower surface 84 of the head 12. The first peripheral limit 82 extends generally about the central opening 38 of the head 12 to define the outer perimeter of the central loading area 78 and limit outward travel of coins from the central loading area, except through an infeed opening 86 formed between the spaced-apart leading and trailing ends 88 and 90, respectively, of the first peripheral limit. The first peripheral limit serves as a circumferential retaining wall which projects downward to nearly the upper surface of the frictional pad 40 and forms a barrier to outward travel of the coins. The first peripheral limit 82 extends more than half way around the central opening 38 of the head 12.

The leading and trailing ends 88 and 90 of the first peripheral limit 82 are spaced apart by a selected amount to restrict the circumferential length of the infeed opening 86 to regulate the flow of coins from the central opening into an infeed area 92 to a pre-determined rate which maximizes the speed of the coin processing without causing jambs by flooding the infeed area with coins or packing the coins too tightly together as they pass under the head during processing.

The infeed area 92 is located under the head and receives coins primarily from the central loading area 78 through the infeed opening 86. The infeed area 92 has a height sufficient to permit substantially unrestricted outward travel of the coins therein toward a second peripheral limit 94 positioned across from and outward from the infeed opening 86. The height for U.S. coinage is slightly less than the thickness of the half-dollar. The infeed opening 86 has a circumferential length that allows coins to enter, particularly those entering just downstream from the trailing edge 90 of the first peripheral limit 82 (such as coin A), and to move quickly through the infeed area 92 to the second peripheral limit 94 since the infeed area has a height so as to not significantly restrict outward movement of the coins therein. The flow of coins into and within the infeed area 92 is illustrated by the coins A, B, C, D, E and F with their sequential positions so numbered.

The second peripheral limit 94 is a retaining wall which projects downwardly to nearly the upper surface of the frictional pad 40 and forms a barrier to outward travel of the coins while they are in the infeed area 92. The second peripheral limit 94 extends in a generally outward circumferentially extending spiral commencing at a point 95. By the time the coins have entered the infeed area 92, many face and edge stacked coins will have already been placed in a single layer as a result of their tendency to move in outward spiral path under the influence the rotating disc 36 applies to the coins through frictional engagement with the frictional pad 40.

An inner circumferential edge wall 96 defined by the inner edge of the head extending about the central opening 38 along the infeed opening 86 tends to knock the upper coins of some face-stacked coins off the stack as the coins enter the space between the lower surface 84 of the head 12 and the upper surface of the frictional pad 40. Since the infeed upper 92 had a height sufficient to permit substantially unrestricted outward travel of the coins, double face-stacked thinner coins, such as dimes, may be too short to be acted upon by the edge wall 96. While this permits more face-stacked coins to enter under the head 12 and requires the head to be more effectively eliminate face-stacked coins, the increasee height of the infeed area 92 when compared to the entry areas of prior known coin queueing heads allows easier entry of even the thickest coins under the head and allows a freer movement of the coins to promote their seeking an early queue along the second peripheral limit 94 once under the head. This increases the speed and reliability of the apparatus 10.

As will be described below, even though more face-stacked coins may enter under the head, the present invention facilitates their lateral separation without the use of an edge wall positioned transverse to the travel of the coins. As such, the head 12 of the present invention provides for rapid and reliable processing of the coins without the abrasive effect the edge of the transverse wall has on the coins.

The use of an enlarged height for the infeed area 92, as well as other processing areas of the head 12, as will be described below, reduces the need for difficult and time-consuming precision setting of the height of the head above the frictional pad 40 required by prior heads. This is partially because the head of the present invention does not depend primarily upon separation of face-stacked coins by the edge wall engaging the upper coin of the stack in the area where the coins enter under the head from the central opening. In the past, this and the particular guides used, required the head be positioned above the disc within close distance tolerances to operate properly.

From the infeed area 92, the coins next pass into a coin processing channel 98 under the head 12. The channel 98 extends in a generally outward circumferentially extending spiral from the infeed area to an outfeed opening 100 at the perimeter of the head 12. The channel 98 has a width greater than the diameter of the largest diameter coin to be processed. The channel 98 is defined along its outer perimeter by a third peripheral limit 102 which extends in a generally outward circumferentially extending spiral continuous with the spiral of the second peripheral limit 94 and extends to the point 103 at the outfeed opening 100. The second and third peripheral limits in combination extend at least one full revolution about the central opening 38. The third peripheral limit 102 is a retaining wall which projects downward to nearly the upper surface of the frictional pad 40 and forms a barrier to outward travel of the coins while they are in the channel 98 up to a point 105. The shape and function of the third peripheral limit 102 between the points 103 and 105 will be described below. The channel 98 has first, second and third length-wise portions 104, 106 and 108, respectively.

The first channel portion 104 receives the coins from the infeed area 92 and has the same height as the infeed area 92, which height is sufficient to permit substantially unrestricted outward travel of the coins therein toward the third peripheral limit 102. The height is, however, selected to partially depress any double face-stacked coins into the flexible frictional pad 40 in order to apply a drag force on the upper coin of the double face-stacked coins to affect at least partial lateral separation thereof while still permitting at least limited outward movement of most thicknesses of non-face stacked coins of the coins being processed. The height is uniform across the full width of the first channel portion 104. In the presently preferred embodiment the height is selected to partially capture at least some of the double face-stacked coins to press any such coins into the frictional pad 40 enough to hold the coins in their radial position as they are carried along by the rotation of the frictional pad. As will be explained below, when these coins leave the second channel portion 106 they will experience increased outward travel to facilitate their complete lateral separation.

The second channel portion 106 receives the coins from the first channel portion 104 and has a height gradually sloping downward toward the frictional pad 40 in the direction of travel of the coins. The height is uniform across the full width of the second channel portion 106 and slopes in the direction of coin travel from substantially the full height of the first channel portion to a reduced height sufficiently close to the upper surface of the frictional pad to depress any face stacked coins into the pad in order to apply an even greater drag force on the upper coin of the double-face stacked coins than was applied in the first channel portion. Because of the downward sloping height, the drag force progressively increases as the coins move through the second channel portion 106. While limiting outward movement of most coins, the downward sloping height achieves at least partial lateral separation of most of the double face-stacked coins.

The reduced height of the second channel portion 106 also tends to depress the double face-stacked coins sufficiently to cause them to rotate relative to each other, further facilitating their lateral separation. As previously noted, the lower surface 84 of the head 12 is a low-friction surface, preferably made of a durable metal, at least in the areas of engagement with the coins. As such, when double face-stacked coins are captured between the low friction surface of the head 12 and the higher friction surface of the frictional pad 40, with enough pressure being applied, they tend to rotate relative to each other with the top coin tending to spin or spiral off the lower coin in an outward direction. By utilizing this action, at least partial lateral separation in the outward direction of double face-stacked coins can be accomplished.

The downward sloping height of the second channel portion 106 is also selected such that double face-stacked coins are relieved of the influence a thick coin, with a similar height and traveling in proximity therewith either in front or behind, may have. The closeness of such a coin tends to hold the frictional pad 40 somewhat away from the lower surface 84 of the head 12 and reduce the vertical force the pad applies to any double face-stacked coins close by. With certain combinations of coins, this sufficiently reduces the drag force on the upper coin, as a result of reducing the vertical force the flexible frictional pad 40 applies on the double face-stacked coins, so as to inhibit even their partial lateral separation. The second channel portion 106 projects downward toward the upper surface of the frictional pad 40, at least along a portion of its length, sufficient to press both double face-stacked coins and any other coins in proximity therewith into the pad such that the necessary vertical force is applied to the double face-stacked coins to create the drag needed for at least initiating their lateral separation. The action of the ramped height of the second channel portion 106 is particularly important to achieve separation of face-stacked dimes when processing U.S. coinage.

It is noted that the lateral separation resulting from the drag effect causes the upper coin of the double-face-stacked coins to move rearward relative to the direction of motion of the lower coin. It is further noted, that without further action by the head 12, many of the partially laterally separated face-stacked coins would not completely separate. This is particularly true with respect to face-stacked coins which are traveling along adjacent to the third peripheral limit 102.

Figure 8:
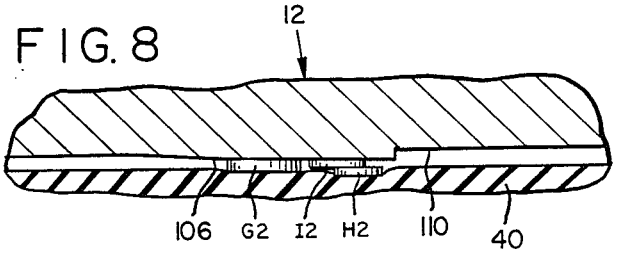
FIG. 8 is an enlarged, fragmentary, sectional view taken substantially along the line 8—8 of FIG. 5.

To facilitate the complete lateral separation of double face-stacked coins partially separated in the first and second channel portions 104 and 106, a third channel portion 108 receives the coins from the second channel portion and has a height sufficient to permit substantially unrestricted outward travel of the coins. The height of the third channel portion 108 is uniform across its full width, but as will be described below, the third channel portion has two lengthwise portions with different heights. The transition distance between the reduced height end portion of the second channel portion 106 portion and the adjacent beginning portion of the third channel portion 108 is sufficiently short to produce a quick release of the double face-stacked coins from under the reduced height portion of the second channel portion. In other words, there is provided a sharp step in height between the second channel portion 106 and the third channel portion 108. This allows the resiliency of the frictional pad 40 to apply a propelling upward force on the double face-stacked coins which tends to vertically separate them, or at least reduce the force holding them together, and allow the centrifugal force created by the rotation of the disc 36 to further laterally separate the coins in the outward direction. The resulting bounce or popping effect facilitates the frictional pad 40 carrying the lower coin of the double face-stacked coins further in the laterally outward direction than the upper coin travels. The action on coins in the second and third channel portions 106 and 108 is illustrated by the coins G, H and I in FIG. 5 as they move through their sequentially numbered positions. The second position of the coins G, H and I is also shown in cross-section in FIG. 8.

For double face-stacked coins that are traveling adjacent to the third peripheral limit 102 in the second channel portion 106, even such a quick release will many times not be sufficient to cause complete lateral separation of the double face-stacked coins because their position at the third peripheral limit limits the outward travel the coins can experience. To provide increased outward travel of partially separated double face-stacked coins, even for those coins already at the third peripheral limit 102 while traveling in the second channel portion 106, the third channel portion 108 has an outwardly expanded area 110. The expanded area 110 is defined by an outwardly projecting or bulging lengthwise portion of the third peripheral limit 102 positioned just downstream from the reduced height end portion of the second channel portion 106 whereat the double face-stacked coins are released from capture and freed to travel outward substantially unrestricted in the third channel portion 108 to accomplish full lateral separation.

As previously noted, the height of the second channel portion 106 is selected to capture at least some of the double face-stacked coins and maintain their radial position as they are carried along by the frictional pad 40. Since the channel 98 and the third peripheral limit 102 spiral outwardly, maintaining the radial portion of the double face-stacked coins results in them being spaced progressively farther away from the third peripheral limit as they are carried along. This spacing is increased by the outward projecting expanded area 110. The result is an increased distance through which the partially separated double face-stacked coins may travel outward upon release from being trapped by the reduced height of the second channel portion 106 to facilitate their full separation.

For coins in the infeed area 92 which are positioned inward of the second peripheral limit 94 too far to travel into the mouth of receiving end of the first channel portion 104, the first peripheral limit 82 has a guide portion 112 extending circumferentially in the direction of travel of the coins commencing at the leading end 88 of the first peripheral limit. The guide portion 112 is positioned inward of the third peripheral limit 102 adjacent to the mouth of the first channel portion 104. The guide portion 112 slopes downwardly from the leading end 88 toward the frictional pad 40 in the direction of travel of the coins to a distance above the upper surface of the frictional pad sufficient to capture any coins passing thereunder. The guide portion 112 is shaped so that the captured coins will be carried along as the frictional pad 40 rotates to a trailing end 114 of the guide portion to pass any of the captured coins to under the next adjacent portion of the first peripheral limit 82 for recirculation back into the infeed area 92.

The guide portion 112 and the adjacent portion of the first peripheral limit 82 depress any of the coins captured thereunder into the frictional pad 40 sufficient to substantially maintain their radial position as the frictional pad rotates. The shape of the first peripheral limit 82 causes any coins captured under the guide portion 112 to be carried around to the trailing end 90 of the first peripheral limit whereat they are released into the infeed area 92 inward of the second peripheral limit 94. The coin is then free to move to the second peripheral limit 94.

The portion of the first peripheral limit 82 extending downstream of the trailing end 114 of the guide portion 112 increases in width as it approaches the trailing end 90 of the first peripheral limit. At the trailing end 90 of the first peripheral limit 82, the coins are provided with a quick release over a sufficiently short distance, or in other words, there is a sharp step, to apply a propelling upward force tending to vertically separate or reduce the force holding together any double face-stacked coins which might be captured and thereby facilitate their lateral separation. This is done in the matter discussed above with respect to the transition between the second and third channel portions 106 and 108. The action on the coins is illustrated by the coin F in FIG. 5 as it moves through its sequentially numbered positions.

The trailing end 90 of the first peripheral limit 82 extends approximately along a radial line and has an inward corner 119 positioned sufficiently inward so as to prevent coins entering into the infeed area 92 through the infeed opening 86 from interfering with the coins exiting from under the first peripheral limit into the infeed area. As shown in FIG. 5 with coin A, the coin moves in a generally spiral path as it moves out of the central loading area 78 and pass the corner 119, leaving a free area downstream of the trailing and 90. If this free area is not maintained, coins depressed under the first peripheral limit 82 while being recirculated exit at the trailing and 90 and find themselves passing immediately under the non-depressed coins entering the infeed area 92, thus actually creating stacks of face-stacked coins.

The guide portion 112 further slopes downwardly toward the frictional pad 40 from the height of the first channel portion 104 in the radially inward direction. This tends to allow any coins passing into the first channel portion 104, but having an inward edge just barely catching the guide portion 112 to be released outwardly into the first channel portion if the frictional pad 40 is applying sufficient outward force on the coin to pull it from under the guide portion. If, however, the coin is radially inward from the second peripheral limit 94 sufficient to be firmly captured under the guide portion 112, it will not be released, but will be recirculated into the infeed area 92 in the manner described above. If the coin is radially inward from the second peripheral limit 94 sufficient for that its outward edge catches an inward face 113 of the guide portion 112, which face serves as a portion of the retaining wall of the first peripheral limit 82, the coin will not be captured, but rather diverted back into the central loading area 78. This action on the coin is illustrated by the coin M in FIG. 5.

The head 12 is further provided with a camming lobe 116. The lobe 116 projects outward from an inward wall 118 of the third channel portion 108 into the third channel portion. The lobe 116 projects outward beyond an adjacent inward wall portion 120 of the second channel portion 106 and cams any coins it engages outward toward the third peripheral limit 102. Any coins traveling in the second channel portion 106 inward from the third peripheral limit 102 sufficient to engage the lobe 116 when the coins pass into the third channel portion 108 will not only be free to move laterally as a result of the increased height of the third channel portion, but will also be provided with an outwardly directed force to facilitate their movement toward the third peripheral limit. The lobe 116 is located toward the entry of the third channel portion 108, generally across from the expanded area 110.

When processing a variety of coins having different diameters and thicknesses, it has been found that certain of the larger diameter and thicker coins will not fully move to the third peripheral limit 102 as a result of the slightly restricting height of the first channel portion 104 and the even more reduced height of the second channel portion 106. In the case of United States coinage, it has been found that the half-dollar sometimes ridges inward of the third peripheral limit 102, tending to maintain its radial position and travel a circumferential path in the first and second channel portions. The lobe 116 is necessary to effect a rapid outward movement of the half-dollar when it enters the third channel portion 108 to ensure it enters the queue against the third peripheral limit by the time it leaves the outfeed opening 100. The same travel pattern occurs with certain double face-stacked coins. The action on the coins is illustrated by the coin J in FIG. 5 as it moves through its sequentially numbered positions.

The lobe 116 also facilitates destacking of double face-stacked coins. The lobe 116 projects outwardly toward the third peripheral limit 102 and downwardly to a distance above the upper surface of the frictional pad 40 sufficient to capture thereunder the lower coin of at least some of the double face-stacked coins engaged by the lobe. Double face-stacked coins entering and passing through the first channel portion 104 at a position inward of the third peripheral limit 102, maintain their radial position as the frictional pad 40 rotates and carries them through the first and second channel portion 106. If sufficiently far inward, they are carried into engagement with the lobe 116. For certain thicknesses of coins, the double face-stacked coins have sufficient thickness that the reduced height portion of the second channel portion 106 pushes the lower coin of the stack downward to below the lower face of the lobe 116. As such, the lower coin will be captured under the lobe 116 and the upper coin will be cammed outward. Thus, complete lateral separation of the coins is accomplished even though the stack is at an extreme inward position away from the third peripheral limit 102 at a point sufficiently downstream in the coin flow that lateral separation might not otherwise occur. The lobe 116 is positioned to pass any coins captured thereunder to the first peripheral limit 82 for recirculation back into the infeed area 92. The action on the coins is illustrated by the coins K and L in FIG. 3 as they move through their sequentially numbered positions.

Figure 10:
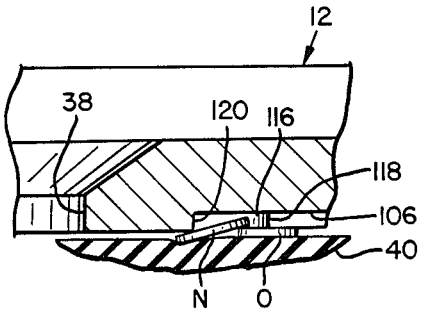
FIG. 10 is an enlarged, fragmentary, sectional view showing the operation of the lobe of the present invention on the pitched coin shown in FIG. 3.

The lobe 116 also serves to eliminate the pinching effect a coin captured under the first peripheral limit 82 by the guide portion 114 may have on an adjacent coin traveling through the first and second channels 104 and 105, if the captured coin extends partway outward into the channels and above the adjacent coin. This is particular problem with U.S. dimes. This tends to pinch particularly a problem with U.S. dimes. The captured coin tends to pinch and trap the adjacent coin if it is positioned between an outward portion of the captured coin and the frictional pad 40, and inhibit its travel to the third peripheral limit. Upon reaching the lobe 116, the pinched adjacent coin will be cammed outward and released from the effect of the captured coin. The captured coin will continue to travel under the first peripheral limit 82 and be recirculated back into the infeed area 92. The position of two such coins is illustrated by the coins N and O in FIG. 3 and shown in cross section in FIG. 10.

It is noted that in the presently preferred embodiment of the invention, the inward wall 120 of the second channel portion 106 is formed by an outward edge wall portion of the first peripheral limit 82, and that the inward wall 118 of the third channel portion 108 is formed in part by an outward edge wall portion of the first peripheral limit 82 and by an outward edge wall portion of the second peripheral limit 94 in the area in which the infeed area 92. It is further noted that the various guides, peripheral limits, lobes and other components may be milled into the lower surface 84 of the head 12, or be detachable inserts fastened to the head.

Lengthwise portions of the second and third peripheral limits 94 and 102, starting along the trailing portion of the infeed area 92 at point 95 and extending along the third channel portion 108 to the point 124, include an outward beveled edge wall portion 122. The bevel is angled to engage the outward edge of the coins, tending to tilt their inward edge upward. This causes their rotation on the frictional pad 40 to assist in maintaining them against the third peripheral limit as the coins are carried along by the rotating frictional pad. This is particularly important as the coins travel through a first portion of the third channel portion 108.

Figure 9:
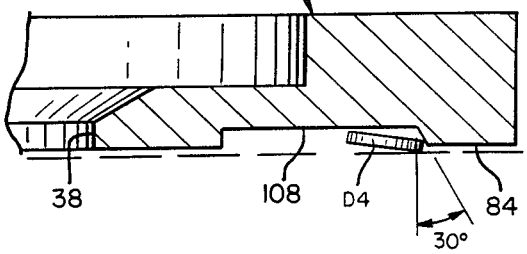
FIG. 9 is an enlarged, fragmentary, sectional view taken substantially along the line 9—9 of FIG. 5.

The rotation is a result of the pad pulling the coin forward as the beveled edge wall engages and causes a drag on the outward edge of the coin. While the first portion of the third channel portion 108 has a height sufficient to permit substantially unrestricted outward travel of the coins, the height selected is still slightly less than the thickness of the thickest coin being processed. As such, during this first portion of the third channel portion, the thicker coins realize a slight capture effect and tend to maintain their radial position and follow a circumferential path instead or freely seeking the helical third peripheral limit 102. Thus, as these thicker coins are carried along, they tend to pull away from the third peripheral limit 102, or more precisely, the third peripheral limit moves away from the coin as its radial distance from the central loading area 78 increases as the coin passes farther along the helical limit. This is illustrated in FIG. 9. In the presently preferred embodiment of the invention the head has a 30° beveled edge wall.

The third peripheral limit 102 has a second edge wall portion 126 extending from the point 124 to the outfeed opening 100 which is not beveled and has a flat edge wall or face to permit coin travel without rotation and allow the coins to move freely to assume a flat attitude against the frictional pad 40 in preparation for their departure from under the head 12.

The third channel portion 108 has a greater height than the thickest coin being processed from a point 130 to the outfeed opening 100. This allows completely unrestricted outward travel of all coins, including the thickest coins being processed, so that there is not even a slight restriction which could tend to capture the coins and cause them to maintain their radial position, thus moving away from the third peripheral limit 102 as the frictional pad 40 carries them toward the outfeed opening 100.

The disc 36, and hence the frictional pad 40 carried thereon, has a horizontally oriented central portion and an upwardly tapered annular perimeter portion toward the peripheral rim 44. The taper is at an angle of about three degrees. A correspondingly sized and positioned upward taper is provided to the lower surface 84 of the head 12 to maintain the desired spacing therebetween. This results in an upward taper of the head 12 outward from the line 128 shown in FIG. 5 to the outer perimeter of the head. The upward taper is first seen by the coins traveling in the third channel portion 108 at the point 130. Due to the helical nature of the channel 98 and the head shape, the taper only affects the head in the area of it farthest outward extent, in particular, in the area of the third channel portion 108 immediately preceding the outfeed opening 100. Since the upward taper in this area matches that of the disc 36, it does not affect the height of the third channel portion 108.

The taper at the perimeter of the head 12 is necessary so that the coins at the peripheral rim 44 of the disc 36 which are laying flat against the frictional pad 40 outward edge wall flat against the inside face of the do not have their outward edge rim flat against the inside face of the peripheral rim. With the taper, the lower part of the outward rim of the coins engages the vertically upright peripheral rim, but the upper part of the outward rim of the coins is held away from the face of the peripheral rim. When using coin-engaging wheels 58 to depress the inward portion of the coins so as to lift arcuately or pivot upward the outward edge of the coins, it is important that the coins do not bind against the peripheral rim as they are pivoted upward, which would inhibit their smooth release from the disc 36.

In the past, it was conventional to taper the disc over its entire width, and hence the head also. This also had the believed desirable effect of holding the coins down flat on the upper surface of the frictional pad through the centrifugal force on the coins. This was thought to stabilize the coins as they traveled by pressing them slightly into the pad. The disadvantages of so tapering the disc and head is that by so holding the coins down, the processing speed is slowed. The present invention eliminates the use of an upward taper except in the radially outward perimeter area where it is considered still necessary to provide the coins with the proper attitude at the peripheral rim 44 for smooth coin release when using coin-engaging wheels.

From the point 105 to the outfeed opening 100, the third peripheral limit 102 has a transition portion 132 sloping upward in height upward to permit the coins against the third peripheral limit to gradually slip outward toward the peripheral rim 44 to provide a smooth but relatively rapid transition between the helical channel 98 and the circular peripheral rim. Without the upward sloping transition portion 132, the coins in the third channel portion 108 are traveling in a helical path, and when they engage the circular peripheral rim and are suddenly restrained to a circular path, become unstable and sometimes jump the peripheral rim. This problem is eliminated by the use of the transition portion 132 with a slope selected to cause a gradual transition from a helical path to a circular path over a relatively short distance that allows the gradual side slippage of the coins. The particular path traveled by a coin under the upward sloping transition portion 132 depends on the weight and thickness of the coin. The action on the coins is illustrated by the coin P in FIG. 5 as it moves through its sequentially numbered positions. While the helical shape of the third peripheral limit 102 could be gradually flared outward to lessen the effect of the transition, the present design provides a rapid and controlled transition for the coins without adverse effect, and maximizes the distance over which the helical channel 98 can extend. It is important to maximize the length of the helical channel while still allowing a sufficiently long sorting area after the coins leave the outfeed opening 100 before they must be kicked off the disc 36 by the ejector wheel 62 if not previously sorted and removed by one of the coin-depressing sorting wheels 58.

With the head 12 of the present invention, a larger variety of coins can be processed, with the head able to place at least 9 different size coins into a queue against the third peripheral limit 102 and provide for their smooth transition to the peripheral rim 44 of the disc 36 so that they exit from the outfeed opening 100 in a single file, single layer queue ready for sorting by denomination. The head 12 can process a mix of coins with greater variation between the thinnest and thickest coins than can heads of the prior art.

The use of an outward spiraling coin processing path, such as provided with the present invention, starting at the infeed area 92 and extending more than a complete revolution about the central opening 38 to the outfeed opening 100, allows all the coins a sufficiently long path and processing time that they have an opportunity to seek and reach the third peripheral limit 102. It also allows face-stacked and edge-stacked coins to be fully separate before leaving the head 36 for sorting. The action on the coins is illustrated by the coins C, D. and Q in FIG. 5 as they move to their positions labeled sequentially numbers 1, 2, 3, 4 and 5. With many of the prior art heads, the length of the coin path while under the head in the processing area, excluding the recirculation area, was not long enough to accomplish the processing without causing recirculation of many coins which slowed the processing rate. With the long spiral path used in the present invention, not only is increased processing time provided, but as the coins progress along the path the inner-coin spacing tends to open up such that even a string of coins positioned closely together along the peripheral limit at the beginning of the processing will tend to separate. The separation is sufficient that edge stacked coins inward of them will, under the influence of the centrifugal force imparted thereto by the friction pad, have an opportunity to insert themselves between the coins in the string and reach the peripheral limit before leaving the head. As such, the rate of flow of coins leaving the head in single file will be increased compared to the prior art heads, which were forced to divert and recirculate the inward edge stacked coins. With the head of the present invention the amount of coin recirculation required is minimized.

In the presently preferred embodiment of the invention, the first, second and third peripheral limits 82, 94 and 102 extend downward from the lower surface 84 of the head 12 to approximately 0.005 inches above the frictional pad 40 and comprise an unaltered face portion of the lower surface 84 of the head 12 which will be used as a reference plane. When designed to process United States coinage, the infeed area 92 and the first channel portion 104 are provided with a substantially uniform height of 0.075 inches. The second channel portion 106 tapers downward in the circumferential direction of coin flow from approximately 0.075 inches in height of the transition from the first channel portion 104 to the second channel portion, to approximately 0.020 inches in height at the transition to the third channel portion 108. The third channel portion has along its first length a substantially uniform height of 0.075 inches and from the point 130 to the outfeed opening 100 has a substantially uniform height of about 0.090 inches above the pad. For reference, the thickness of a U.S. half-dollar is about 0.085 inches and the thickness of a U.S. dime is about 0.053 inches.

In the presently preferred embodiment, the head 12 is sized and shaped to operate with a conventional 12.5 inch diameter disc 36 operating at about 310 rpm. The pitch in the helical second and third peripheral limits 94 and 102 is about 0.665 inches in 225° starting at point 95 and ending at just prior to point 124. Starting just prior to 124, the helical shape is changed to a pitch of about 1.130 in 75° ending just prior to the outfeed opening 100. The lobe 116 extends outward about 0.2 inches from the inward wall 120 of the second channel portion 106 and has a radius of curvature of about 0.62 inches. The reduced height second channel portion 106 extends over about 30° of the head 12. The upwardly sloping transition portion of the third peripheral limit 102 extends over about 47° of the head 12. The infeed opening extends over about 118°.

It will be appreciated that, although specific embodiments of the invention have been described herein for purposes of illustration, various modifications may be made without departing from the spirit and scope of the invention. Accordingly, the invention is not limited except by the appended claims.

We claim:

1. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

an infeed area under said head receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a third peripheral limit following a generally outward spiralling path and defining an outward wall of said channel to limit outward travel of said coins in said channel, said channel having first, second and third lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion, said second channel portion depressing said double-stacked coins sufficiently to cause relative rotation between the coins of a double-stack and thereby facilitate their lateral separation, and depressing said double-stacked coins and any of said coins in proximity with said double-stacked coins having a substantially similar height sufficiently into said flexible surface to prevent the proximity from reducing the drag force said flexible surface causes on the upper coin of said double-stacked coins enough to inhibit their partial lateral separation; and said third channel portion receiving said coins from said second channel portion and permitting substantially unrestricted outward travel of nonstacked coins of said first thickness, the transition between the reduced height portion of said second channel portion and the adjacent portion of said third channel portion being a step away from said flexible surface rising over a sufficiently short distance in the direction of travel of said coins relative to the diameter of said double-stacked coins of said second thickness to provide a quick release of said double-stacked coins from under said reduced height portion of said second channel portion and thereby allow the resiliency of said flexible surface to apply a propelling upward force thereon tending to vertically separate said double-stacked coins, said third channel portion having an outwardly expanded area defined by a lengthwise portion of said third peripheral limit in said third channel portion positioned substantially immediately adjacent to said step and projecting outwardly out of said spiralling path and beyond a lengthwise portion of said third peripheral in said second channel portion positioned immediately adjacent to said step, said portion of said third peripheral limit in said third channel defining a discontinuity in said spiralling path and allowing substantially immediate increased outward movement of said partially separated double-stacked coins beyond the gradual outward movement produced by following said spiralling path upon release thereof from under said reduced height portion of said second channel portion to thereby facilitate further lateral separation of said double-stacked coins, whereby when said head is operated with said flexible surface rotating said coins pass from said outfeed opening in a single layer and a single file ready for sorting by denomination, even when processing face-stacked coins.

2. The coin-queueing head of claim 1 further including a guide positioned inward of said second peripheral limit adjacent to the entry to said first channel portions and sloping downwardly from a leading end toward said flexible surface in the direction of travel of said coins to capture thereunder any of said coins positioned sufficiently inward of said second peripheral limit to travel under said guide, said guide being positioned to pass any of said coins captured to under said first peripheral limit for recirculation back into said infeed area, said guide and said first peripheral limit depressing any of said coins captured thereunder into said flexible surface sufficient to substantially maintain their radial position as said flexible surface rotates.

3. The coin-queueing head of claim 2 wherein said first peripheral limit has an end remote from said guide for release of said coins from under said first peripheral limit, said remote end being positioned to release said coins into said infeed area inward of said second peripheral limit.

4. The coin-queueing head of claim 3 wherein the transition from said remote end of said first peripheral limit to said infeed area is made over a sufficiently short distance to provide a quick release of any double face-stacked coins of said coins from under said first peripheral limit to facilitate lateral separtion thereof.

5. The coin-queueing head of claim 3 wherein said remote end of said first peripheral limit has an inward blocking portion defining one end of said infeed opening and positioned inwardly sufficient to block said coins entering said infeed opening from engaging said coins captured under said peripheral limit as they are released from into said infeed area, whereby an area is provided downstream of said remote end in which said captured coins may be released from under said first peripheral limit without interference with said coins passing from said central opening into said infeed area.

6. The coin-queueing head of claim 2 wherein said guide further slopes downwardly toward said flexible surface in the inward direction.

7. The coin-queueing head of claim 1 wherein said reduced height portion of said second channel portion extends across the full width thereof.

8. The coin-queueing head of claim 1 wherein said second and third peripheral limits define a substantially continuous, generally outward spiralling coin limit extending along said infeed area through said channel to said outfeed opening.

9. The coin-queueing head of claim 8 wherein said second and third peripheral limits in combination extend at least one full revolution about said central opening.

10. The coin-queueing head of claim 1 wherein said third peripheral limit along said third channel portion includes a bevelled first portion extending substantially from said second channel portion to a mid-portion of said third channel portion, with a bevel to engage the outward edge of said coins and cause rotation of said coins as said flexible surface rotates, and a second portion extending from said mid-portion substantially to said outfeed opening without a bevel to permit travel of said coins without rotation, said third channel portion having a height along said second portion of said third peripheral limit without a bevel sufficient to allow completely unrestricted outward travel of nonstacked coins of said coins, whereby said coins are rotated during their travel through said first portion of said third channel portion to assist in maintaining said coins against said third peripheral limit, and then allowed to move outward freely through said second portion of said third channel portion with a flat attitude against said flexible surface in preparation for departure from under the head.

11. The coin-queueing head of claim 1 wherein the length of said first peripheral limit is selected to provide an infeed opening restricted in circumferential length to regulate the flow of said coins from said central opening into said infeed area at a predetermined rate.

12. The coin-queueing head of claim 1 further including a camming lobe projecting from an inward wall of said third channel portion outward into said third channel portion, said lobe projecting outward beyond an adjacent inward wall of said second channel portion and camming outward toward said third peripheral limit any of said coins positioned inward from said third peripheral limit sufficient to engage said lobe, whereby an outwardly directed force is applied to inwardly positioned coins to facilitate their movement to said third peripheral limit.

13. The coin-queueing head of claim 12 wherein said camming lobe is located toward the entry end portion of said third channel portion, generally across from said expanded area.

14. The coin-queueing head of claim 12 wherein said camming lobe projects downwardly to the flexible surface sufficiently to capture thereunder the lower coins of said double-stacked coins engaged thereby, said lobe projecting outwardly into said third channel portion sufficiently to engage any of said double-stacked coins entering said first channel portion at a predetermined distance inward of said third peripheral limit which have an overall thickness sufficient to substantially maintain their radial position as said flexible surface rotates, with said lobe camming the upper coin of said double-stacked coins outward toward said third peripheral limit.

15. The coin-queueing head of claim 14 wherein said camming lobe is positioned to pass any of said coins captured to under said first peripheral limit for recirculation into said infeed area.

16. The coin-queueing head of claim 12 wherein said inward wall is an outward edge wall portion of said first peripheral limit.

17. The con-queueing head of claim 1 wherein said third channel portion extends greater than one-half revolution about said central opening.

18. The coin-queueing head of claim 1 wherein said third channel portion has a leading lengthwise portion having a height at or slightly less than the thickness of the thickest coin being processed, and a trailing lengthwise portion, downstream from said leading portion, having a height greater than the thickness of the thickest coin being processed to remove any restriction on the outward travel of said coins.

19. The coin-queueing head of claim 1 wherein said infeed area and coin processing channel are substantially horizontal, with said third channel portion having an upwardly and outwardly tapered channel portion adjacent to said outfeed opening to place said coins in an upwardly slanted attitude at the perimeter of the rotating flexible surface for exit from under the head.

20. The coin-queueing head of claim 1 wherein said third peripheral limit along an end lengthwise portion of said third channel portion is upwardly sloping away from said flexible surface in the direction of travel of said coins to permit gradual outward travel of said coins from the helical path traveled in said third channel portion to substantially a circular path prior to exiting said outfeed opening, whereby said coins make a smooth but relatively rapid transition from a helical path to a circular path.

21. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins except through an infeed opening therein;

an infeed area under said head receiving said coins from said central opening through said infeed opening, and permitting said nonstacked coins of said first thickness substantially unrestricted outward travel;

a guide positioned at a leading end of said first peripheral limit, said guide being shaped and projecting to a distance above said flexible surface sufficient to capture and depress any of said coins positioned to travel thereunder into said flexible surface, said guide being further positioned to pass any of said captured coins passing thereunder to said first peripheral limit, said first peripheral limit projecting to a distance from said flexible surface to substantially maintain the radial position of said captured coins as said surface rotates and being shaped to guide said captured coins thereunder for recirculation;

a second peripheral limit to limit outward travel of said coins, said second peripheral limit extending outward in a generally spiral shaped path from a position adjacent to a trailing end of said first peripheral limit and outward of said first peripheral limit to a position at the perimeter of said head, said second peripheral limit extending at least one full revolution about said central opening and defining an outward wall of said infeed area and of a coin processing channel under said head, said channel being positioned to receive said coins from said infeed area and deliver said coins to an outfeed opening at the perimeter of said head, an inward wall of said channel being partially defined by an outward wall of said first peripheral limit and partially defined by a portion of an outward wall of said second peripheral limit where said channel overlaps itself, said channel having a width greater than the diameter of the largest diameter coin of said coins, said channel having first, second and third lengthwise portions;

said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness;

said second channel portion receiving said coins from said first channel portion and sloping toward said flexible surface in the direction of travel of said coins to a reduced height portion of said second channel portion and further depressing any of said double stacked coins of said second thickness into said flexible surface in order to apply an increased drag force on the upper coin of said double-stacked coins than applied in said first channel portion for at least partial lateral separation of said double-stacked coins; and said third channel portion receiving said coins from said second channel portion and permitting substantially unrestricted outward travel of nonstacked coins of said first thickness, distance between the portion of said channel portion with said third channel portion including means for providing substantially immediate release of said double-stacked coins of said second thickness from being depressed into said flexible surface upon passage from under said reduced height portion of said second channel portion into said third channel portion to propel said double-stacked coins away from said flexible surface by a resilient force applied by said flexible surface, said third channel portion further including means, substantially adjacent to an end of said second channel portion, for permitting substantially immediate increased outward movement of said partially separated double-stacked coins of said second thickness beyond said spiral shaped path upon release thereof from being depressed into said flexible surface upon passage from under said reduced height portion of said second channel portion into said third channel portion.

22. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

an infeed area under said head receiving said coins from said central opening through said infeed opening, and permitting said nonstacked coins of said first thickness substantially restricted outward travel;

a second peripheral limit positioned across from and outward of said infeed opening to limit to outward travel of said coins in said infeed area;

a coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a third peripheral limit following a generally outward spirally path and defining an outward wall of said channel to limit outward travel of said coins in said channel, said channel having first, second, third and fourth lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion;

said third channel portion receiving said coins from said second channel portion and permitting substantially unrestricted outward travel of nonstacked coins of said first thickness, the transition between the reduced height portion of said second channel portion and the adjacent portion of said third channel portion being a step away from said flexible surface rising over a sufficiently short distance in the direction of travel of said coins relative to the diameter of said double-stacked coins of said second thickness to provide a quick release of said double-stacked coins from under said reduced height portion of said second channel portion and thereby allow the resiliency of said flexible surface to apply a propelling upward force thereon tending to vertically separate said double-stacked coins, said third channel portion having an outwardly expanded area defined by a lengthwise portion of said third peripheral limit in said third channel portion positioned substantially immediately adjacent to said step and projecting outwardly out of said spiralling path and beyond a lengthwise portion of said third peripheral limit in said second channel portion positioned immediately adjacent to said step, said portion of said third peripheral limit in said third channel defining a discontinuity in said spiralling path and allowing substantially immediate increased outward movement of said partially separated double-stacked coins beyond the gradual outward movement produced by following said spiralling path upon release thereof from under said reduced height portion of said second channel portion to thereby facilitate further lateral separation of said double-stacked coins; and said fourth channel portion receiving said coins from said third channel portion and relieving nonstacked coins of said first thickness of all restriction against outward travel.

23. The coin-queueing head of claim 22 further including a guide positioned inward of said second peripheral limit adjacent to the entry to said first channel portion and sloping downwardly from a leading end toward said flexible surface in the direction of travel of said coins to capture thereunder any of said coins positioned sufficiently inward of said second peripheral limit to travel under said guide, said guide being positioned to pass any of said coins captured under said first peripheral limit for recirculation back into said infeed area, said guide and said first peripheral limit depressing any of said coins captured thereunder into said flexible surface sufficient to substantially maintain their radial position as said flexible surface rotates.

24. The coin-queueing head of claim 23 wherein said first peripheral limit has an end remote from said guide for release of said coins from under said first peripheral limit, said remote end being positioned to release said coins into said infeed area inward of said second peripheral limit.

25. The coin-queueing head of claim 24 wherein the transition from said remote end of said first peripheral limit to said infeed area is made over a substantially short distance to provide a quick release of any double face-stacked coins of said coins from under said first peripheral limit to facilitate lateral separation thereof.

26. The coin-queueing head of claim 24 wherein said remote end of said first peripheral limit has an inward blocking portion defining one end of said infeed opening and positioned inwardly insufficient to block said coins entering said infeed opening from engaging said coins captured under said peripheral limit as they are released from into said infeed area, whereby an area is provided downstream of said remote end in which said captured coins may be released from under said first peripheral limit without interference with said coins passing from said central opening into said infeed area.

27. The coin-queueing head of claim 22 wherein said second and third peripheral limits define a substantially continuous, generally outward spiralling coin limit extending along said infeed area through said channel to said outfeed opening, said second and third peripheral limits in combination extending at least one full revolution about said central opening.

28. The coin-queueing head of claim 22 wherein said third peripheral limit extending along at least a portion of said third channel portion is a bevelled wall having a bevel to engage the outward edge of said coins and cause rotation of said coins as said flexible surface rotates, and wherein said third peripheral limit extending along at least a portion of said fourth channel portion is without a bevel a permit travel of said coins without rotation.

29. The coin-queueing head of claim 22 wherein the length of said first peripheral limit is selected to provide an infeed opening restricted in circumferential length to regulate the flow of said coins from said central opening into said infeed area at a predetermined rate.

30. The coin-queueing head of claim 22 further including a camming lobe projecting from an inward wall of said third channel portion outward into said third channel portion, said lobe projecting outward beyond an adjacent inward wall of said second channel portion and camming outward toward said third peripheral limit any of said coins positioned inward from said third peripheral limit sufficient to engage said lobe, whereby an outwardly directed force is applied to inwardly positioned coins to facilitate their movement to said third peripheral limit.

31. The coin-queueing head of claim 30 wherein said camming lobe is located along said third channel portion to engage said coins upon release thereof from under said reduced height portion of said second channel portion.

32. The coin-queueing head of claim 30 wherein said camming lobe projects downwardly to the flexible surface sufficiently to capture thereunder the lower coins of said double-stacked coins engaged thereby, said lobe projecting outwardly into said third channel portion sufficiently to engage any of said double-stacked coins entering said first channel portion at a predetermined distance inward of said third peripheral limit which have an overall thickness sufficient to substantially maintain their radial position as said flexible surface rotates, with said lobe camming the upper coin of said double-stacked coins outward toward said third peripheral limit.

33. The coin-queueing head of claim 32 wherein said camming lobe is positioned to pass any of said coins captured to under said first peripheral limit for recirculation into said infeed area.

34. The coin-queueing head of claim 22 wherein said third and fourth channel portions in combination extends greater than one-half revolution about said central opening.

35. The coin-queueing head of claim 22 wherein said infeed area and coin processing channel are substantially horizontal, with said fourth channel portion having an upwardly and outwardly tapered channel portion adjacent to said outfeed opening to place said coins in an upwardly slanted attitude at the perimeter of the rotating flexible surface for exit from under the head.

36. The coin-queueing head of claim 22 wherein said third peripheral limit along an at least a portion of said fourth channel portion is upwardly sloping away from said flexible surface in the direction of travel of said coins to permit gradual outward travel of said coins from the helical path traveled in said third channel portion to substantially a circular path prior to exiting said outfeed opening, whereby said coins make a smooth but relatively rapid transition from a helical path to a circular path.

37. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a coin processing channel for receiving said coins defined by an outward wall following a generally outward spiralling path to limit outward travel of said coins in said channel, said channel having a first portion sloping toward said flexible surface in the direction of travel of said coins to a reduced height portion of said first portion and depressing any of said double-stacked coins of said second thickness into said flexible surface, and further having a second portion downstream of said first portion for receiving said coins from said first portion and permitting substantially unrestricted outward travel of nonstacked coins of said first thickness, the transition between said reduced height portion of said first portion of said channel and said second portion being a step away from said flexible surface rising over a sufficiently short distance in the direction of travel of said coins relative to the diameter of said double-stacked coins of said second thickness to provide a quick release of said double-stacked coins from under said reduced height first portion and thereby allow the resiliency of said flexible surface to apply a propelling force thereon away from said flexible surface tending to vertically separate said double-stacked coins, said second portion having an outwardly expanded area immediately downstream of said step defined by a lengthwise portion of said outward wall positioned immediately adjacent to said step and projecting abruptly outward beyond a lengthwise portion of said outward wall positioned immediately upstream of said step in said first portion by a sufficient distance to permit substantially immediate increased outward movement of said partially separated double-stacked coins of said second thickness beyond said lengthwise portion of said outward wall in said first portion upon release thereof from under said reduced height first portion to facilitate further lateral separation of said double-stacked coins.

38. The coin-queueing head of claim 37 further including a camming lobe projecting outward into said second portion of said channel for camming outward toward said outward wall any of said coins positioned inward therefrom sufficiently to engage said lobe upon release from under said reduced height first portion of said channel.

39. The coin-queueing head of claim 38 wherein said camming lobe is located generally inward and across from said expanded area.

40. A coin-queueing head positionable in a spaced relationship over a rotating flexible surface with a circular peripheral coin retaining rim to process coins and place them in a single layer, single file, comprising:

a coin processing channel for receiving said coins and defined by an outward to limit outward travel of said coins in said channel, said channel having a portion with a generally outward spiral for delivering coins to an outfeed opening at the perimeter of said head adjacent to the circular peripheral rim, said outward wall along a lengthwise end portion of said spiral channel portion having a wall portion upwardly sloping away from said flexible surface in the direction of travel of said coins to permit gradual outward travel of said coins from the helical path traveled in said channel portion to substantially a circular path prior to exiting said outfeed opening, said sloping wall portion providing said coins with a smooth but relatively rapid transition from their helical path to a circular path defined by the peripheral rim.

41. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins except through an infeed opening therein;

an infeed area under said head receiving said coins from said central opening through said infeed opening;

a second peripheral limit to limit outward travel of said coins, said second peripheral limit extending outward in a generally spiral shaped path from a position adjacent to a trailing end of said first peripheral limit and outward of said first peripheral limit to a position at the perimeter of said head, said second peripheral limit extending at least one full revolution about said central opening and defining an outward wall of said infeed area and of a coin processing channel under said head, said channel being positioned to receive said coins from said infeed area and deliver said coins to an outfeed opening at the perimeter of said head, said channel having a width greater than the diameter of the largest diameter coin of said coins, said channel having first, second and third lengthwise portions;

said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins; and said third channel portion receiving said coins from said second channel portion and permitting substantially unrestricted outward travel of said first thickness, said third channel portion including release means for substantially immediately releasing said double-stacked coins of said second thickness from being depressed into said flexible surface upon passage from under said reduced height portion of said second channel portion into said third channel portion, and said second peripheral limit including means for permitting increased outward movement of said partially separated double-stacked coins beyond said spiral shaped path substantially immediately upon release thereof from being depressed into said flexible surface by said release means so as to facilitate further lateral separation of said double-stacked coins.

42. A coin-sorting apparatus, comprising:

a rotatable disc having a flexible surface, said disc having a generally circular central portion with a horizontally oriented surface, and an annular perimeter portion extending about said central portion and having an upwardly outward taper to provide an upwardly tapered surface adjacent to a peripheral rim extending about the perimeter of the disc, said peripheral rim extending upward beyond said resilient surface for engaging the edge of coins on the surface; and a coin-queueing head positionable in a spaced relationship over said disc above said flexible surface to process randomly oriented coins and place them in a single layer, single file at said peripheral rim, said head including:

a central opening for receiving said randomly oriented coins;

a first peripheral limit extending circumferentially about said central opening to limit outward travel of said coins from said central opening and to define an infeed opening for passage of said coins therethrough;

an infeed area under said head for receiving said coins from said central opening through said infeed opening;

a second peripheral limit positioned across from and outward of said infeed opening to limit the outward travel of said coins in said infeed area;

a coin-processing channel for receiving said coins from said infeed area, said channel extending in a generally outward spiral from said infeed area to an outfeed opening at the perimeter of said head adjacent to said peripheral rim, said channel having a width greater than the diameter of the largest diameter coin of said coins and including a generally outward spiralling third peripheral limit defining an outward wall of said channel to limit outward travel of said coins in said channel having an upwardly and outwardly tapered channel portion adjacent to said outfeed opening to place said coins in an upwardly slanted attitude at the perimeter of said disc for exit from under said head, whereby said coins are processed to place them in a single layer, single file in a substantially horizontally oriented infeed area and coin processing channel, and then provided with an upwardly slanted attitude as they exit from under the head for sorting along said peripheral rim with said coins having an upwardly slanted attitude for sorting; and a plurality of coin-engaging wheels attached to said head and positioned to engage an inward portion of said coins as they travel at said peripheral rim after their exit from under said head for sorting by denomination.

43. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

an infeed area under said head receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a generally outward spiralling third peripheral limit defining an outward wall of said channel to limit outward travel of said coins in said channel, said channel having first, second and third lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion, said second channel portion depressing said double-stacked coins sufficiently to cause relative rotation between the coins of a double-stack and thereby facilitate their lateral separation, and depressing said double-stacked coins and any of said coins in proximity with said double-stacked coins having a substantially similar height sufficiently into said flexible surface to prevent the proximity from reducing the drag force said flexible surface causes on the upper coin of said double-stacked coins enough to inhibit their partial lateral separation;

said third channel portion receiving said coins from said second channel portion and permitting substantially unrestricted outward travel of nonstacked coins of said first thickness, the transition distance between the reduce height portion of said second channel portion and the adjacent portion of said third channel portion being sufficiently short to provide a quick release of said double-stacked coins of said second thickness from under said reduced height portion of said second channel portion and thereby allow the resiliency of said flexible surface to apply a propelling upward force thereon tending to vertically separate said double-stacked coins, said third channel portion having an outwardly expanded area defined by an outwardly projecting lengthwise portion of said third peripheral limit positioned to permit substantially immediate increased outward movement of said partially separated double-stacked coins upon release thereof from under said reduced height portion of said second channel portion and thereby facilitate further lateral separation of said double-stacked coins, whereby when said head is operated with said flexible surface rotating said coins pass from said outfeed opening in a single layer and a single file ready for sorting by denomination, even when processing face-stacked coins; and a camming lobe projecting from an inward wall of said third channel portion outward into said third channel portion, said lobe projecting outward beyond an adjacent inward wall of said second channel portion and camming outward toward said third peripheral limit any of said coins positioned inward from said third peripheral limit sufficient to engage said lobe, whereby an outwardly directed force is applied to inwardly positioned coins to facilitate their movement to said third peripheral limit.

44. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

a substantially horizontal infeed area under said head for receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a substantially horizontal coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a generally outward spiralling third peripheral limit defining an outward wall of said channel to limit outward travel of said coins in said channel, said channel having first, second and third lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion, said second channel portion depressing said double-stacked coins sufficiently to cause relative rotation between the coins of a double-stack and thereby facilitate their lateral separation, and depressing said double-stacked coins and any of said coins in proximity with said double-stacked coins having a substantially similar height sufficiently into said flexible surface to prevent the proximity from reducing the drag force said flexible surface causes on the upper coin of said double-stacked coins enough to inhibit their partial lateral separation; and said third channel portion receiving said coins from said second channel portion and permitting substantially unrestricted outward travel of nonstacked coins of said first thickness, the transition distance between the reduced height portion of said second channel portion and the adjacent portion of said third channel portion being sufficiently short to provide a quick release of said double-stacked coins of said second thickness from under said reduced height portion of said second channel portion and thereby allow the resiliency of said flexible surface to apply a propelling upward force thereon tending to vertically separate said double-stacked coins, said third channel portion having an outwardly expanded area defined by an outwardly projecting lengthwise portion of said third peripheral limit positioned to permit substantially immediate increased outward movement of said partially separated double-stacked coins upon release thereof from under said reduced height portion of said second channel portion and thereby facilitate further lateral separation of said double-stacked coins, said third channel portion having an upwardly and outwardly tapered channel portion adjacent to said outfeed opening to place said coins in an upwardly slanted attitude at the perimeter of the rotating flexible surface for exit from under the head, whereby when said head is operated with said flexible surface rotating said coins pass from said outfeed opening in a single layer and a single file ready for sorting by demonstration, even when processing face-stacked coins.

45. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

an infeed area under said head receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a generally outward spiralling third peripheral limit defining an outward wall of said channel to limit outward travel of said coins in said channel, said channel having first, second, third and fourth lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion;

said third channel portion receiving said coins from aid second channel portion and permitting substantially unrestricted outward travel of nonstacked coins of said first thickness, the transition distance between the reduced height portion of said second channel portion and the adjacent portion of said third channel portion being sufficiently short to provide a quick release of said double-stacked coins of said second thickness from under said reduced height portion of said second channel portion and thereby allow the resiliency of said flexible surface to apply a propelling upward force thereon tending to vertically separate said double-stacked coins, said third channel portion having an outwardly expanded area defined by an outwardly projecting lengthwise portion of said third peripheral limit positioned to permit substantially immediate increased outward movement of said partially separated double-stacked coins upon release thereof from under said reduced height portion of said second channel portion and thereby facilitate further lateral separation of said double-stacked coins;

said fourth channel portion receiving said coins from said third channel portion and relieving nonstacked coins of said first thickness of all restriction against outward travel; and a camming lobe projecting from an inward wall of said third channel portion outward into said third channel portion, said lobe projecting outward beyond an adjacent inward wall of said second channel portion and camming outward toward said third peripheral limit any of said coins positioned inward from said third peripheral limit sufficient to engage said lobe, whereby a outwardly directed force is applied to inwardly positioned coins to facilitate their movement to said third peripheral limit.

46. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening of passage of said coins therethrough;

a substantially horizontal infeed area under said head for receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a substantially horizontal coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a generally outward spiralling third peripheral limit defining an outward wall of said channel to limit outward travel of said coins in said channel, said channel having first, second, third and fourth lengthwise portions, said first channel portion receiving said coins from said infeed area and partially depressing any double face-stacked coins of said second thickness into said flexible surface in order to apply a drag force on the upper coin of said double-stacked coins for at least partial lateral separation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins then applied in said first channel portion for at least partial lateral separation of said double-stacked coins, and to substantially maintain the radial position of said double-stacked coins as they travel the length of said second channel portion;

said third channel portion receiving said coins from said second channel portion and permitting substantially unrestricted outward travel of nonstacked coins of said first thickness, the transition distance between the reduced height portion of said second channel portion and the adjacent portion of said third channel portion being sufficiently short to provide a quick release of said double-stacked coins of said second thickness from under said reduced height portion of said second channel portion and thereby allow the resiliency of said flexible surface to apply a propelling upward force thereon tending to vertically separate said double-stacked coins, said third channel portion having an outwardly expanded area defined by an outwardly projecting lengthwise portion of said third peripheral limit positioned to permit substantially immediate increased outward movement of said partially separated double-stacked coins upon release thereof from under said reduced height portion of said second channel portion and thereby facilitate further lateral separation of said double-stacked coins; and said fourth channel portion receiving said coins from said third channel portion and relieving nonstacked coins of said first thickness of all restriction against outward travel, said fourth channel portion having an an upwardly and outwardly tapered channel portion adjacent to said outfeed opening to place said coins in an upwardly slanted attitude at the perimeter of the

47. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a central opening in said head for receiving said randomly oriented coins;

a first peripheral limit extending generally circumferentially about said central opening to limit outward travel of said coins from said central opening and to define an infeed opening for passage of said coins therethrough;

an infeed area under said head for receiving said coins from said central opening through said infeed opening, and permitting said nonstacked coins of said first thickness substantially unrestricted outward travel;

a second peripheral limit positioned across from and outward of said infeed opening to limit the outward travel of said coins in said infeed area;

a coin processing channel under said head for receiving said coins from said infeed area, said channel extending in a generally outward spiral from said infeed area to an outfeed opening at the perimeter of said head, said channel having a width greater than the diameter of the largest diameter coin of said coins and including a generally outward spiralling third peripheral limit defining an outward wall of said channel to limit outward travel of said coins in said channel, said channel having first, second, third and fourth lengthwise portions, said first channel portion receiving said coins from said infeed area and partially depressing any double face-stacked coins of said second thickness into said flexible surface in order to apply a drag force on the upper coin of said double-stacked coins for at least partial lateral seperation thereof while still permitting substantially unrestricted outward travel of nonstacked coins of said first thickness, said first channel portion partially capturing at least certain of said double-stacked coins to substantially maintain the radial position of said double-stacked coins as they travel the length of said first channel portion;

said second channel portion receiving said coins from said first channel portion and sloping toward said flexible surface in the direction of travel of said coins to a reduced height portion of said second channel portion and further depressing any of said double-stacked coins of said second thickness into said flexible surface in order to apply an increased drag force on the upper coin of said double-stacked coins than applied in said first channel portion for at least partial lateral separation of said double-stacked coins, and to substantially maintain the radial position of said double-stacked coins as they travel the length of said second channel portion;

said third channel portion receiving said coins from said second channel portion and permitting substantially unrestricted outward travel of nonstacked coins of said first thickness, the transition distance between the reduced height portion of said second channel portion and the adjacent portion of said third channel portion being sufficiently short to provide a quick release of said double-stacked coins of said second thickness from under said reduced height portion of said second channel portion and thereby allow the resiliency of said flexible surface to apply a propelling upward force thereon tending to vertically separate said double-stacked coins, said third channel portion having an outwardly expanded area defined by an outwardly projecting lengthwise portion of said third peripheral limit positioned to permit substantially immediate increased outward movement of said partially separated double-stacked coins upon release thereof from under said reduced height portion of said second channel portion and thereby facilitate further lateral separation of said double-stacked coins; and said fourth channel portion receiving said coins from said third channel portion and relieving nonstacked coins of said first thickness of all restriction against outward travel, said third peripheral limit along an at least a portion of said fourth channel portion being upwardly sloping away from said flexible surface in the direction of travel of said coins to permit gradual outward travel of said coins from the helical path traveled in said third channel portion to substantially a circular path prior to exiting said outfeed opening, whereby said coins make a smooth but relatively rapid transition from a helical path to a circular path.

48. A coin-queueing head positionable in a spaced relationship over a rotating flexible surface to process randomly oriented coins and place them in a single layer, single file, said coins including nonstacked coins with a first coin having a first thickness and including a second coin having a second thickness, said second coins when double-face stacked in combination having a thickness substantially equal to said first thickness, comprising:

a coin processing channel for receiving said coins defined by an outward wall to limit outward travel of said coins in said channel, said channel having a first portion sloping toward said flexible surface in the direction of travel of said coins to a reduced height portion of said first portion and depressing any of said double-stacked coins of said second thickness into said flexible surface, and further having a second portion downstream of said first portion for receiving said coins from said first portion and permitting substantially unrestricted outward travel of nonstacked coins of said first thickness, the transition distance between said reduced height portion of said first portion of said channel and said second portion being sufficiently short to provide a quick release of said double-stacked coins from under said reduced height first portion and thereby allow the resiliency of said flexible surface to apply a propelling force thereon away from said flexible surface tending to vertically separate said double-stacked coins, said second portion having an outwardly expanded area defined by an outwardly projecting lengthwise portion of said outward wall positioned to permit substantially immediate increased outward movement of said partially separated double-stacked coins of said second thickness upon release thereof from under said reduced height first portion to facilitate further lateral separation of said double-stacked coins; and a camming lobe projecting outward into said second portion of said channel for camming outward toward said outward wall any of said coins positioned inward therefrom sufficiently to engage said lobe upon release from under said reduced height first portion of said channel.

49. A coin-queueing head positionable in a spaced relationship over a rotating flexible surface to process randomly oriented coins having a first thickness and place them in a single layer, single file, comprising:

a coin processing channel for receiving said coins defined by an outward wall following a generally outward spiralling path to limit outward travel of said coins in said channel, said channel having a first channel portion sloping toward said flexible surface in the direction of travel of said coins to a reduced height portion of said first channel portion having a height above said flexible surface less than said first thickness and depressing any of said double-stacked coins of said first thickness into said flexible surface, and further having a second channel portion downstream of said first channel portion for receiving said coins from said first channel portion and having a height above said flexible surface sufficiently greater than said first thickness to permit substantially unrestricted outward travel of said double-stacked coins of said first thickness, the transition between said reduced height portion of said first channel portion and said second channel portion being a step away from said flexible surface rising over a sufficiently short distance in the direction of travel of said coins relative to the diameter of said double-stacked coins of said first thickness to provide a quick release of said double-stacked coins from under said reduced height first portion and thereby allow the resiliency of said flexible surface to apply a propelling force thereon away from said flexible surface tending to vertically separate said double-stacked coins, said second channel portion having an outwardly expanded area immediately downstream of said step extending outward beyond said spiralling path to permit substantially immediate outward movement of said released double-stacked coins.

50. The coin-queueing head of claim 49 wherein said outwardly expanded area is defined by a lengthwise portion of said outward wall positioned immediately adjacent to said step and projecting abruptly outward by a sufficient distance to permit substantially immediate increased outward movement of said partially separated double-stacked coins of said first thickness beyond a lengthwise portion of said outward wall of said first channel portion positioned immediately upstream of said step upon release thereof from under said reduced height portion to facilitate further lateral separation of said double-stacked coins.

51. The coin-queueing head of claim 50 further including a camming lobe projecting outward into said second channel portion for camming outward toward said outward wall any of said coins positioned inward therefrom sufficiently to engage said lobe upon release from under said reduced height portion.

* * * * *

UNITED STATES PATENT AND TRADEMARK OFFICE

CERTIFICATE OF CORRECTION

PATENT NO. : 4,775,353

DATED : October 4, 1988

INVENTOR(S) : Roger K. Childers, Kenneth L. Buchanan, Russel Darmour II

It is certified that error appears in the above-identified patent and that said Letters Patent is hereby corrected as shown below:

Claim 2, line 20, delete "portions" and substitute therefor --portion--.

Claim 17, line 64, delete "con" and substitute therefor --coin--.

Claim 21, column 23, lines 32-33, delete the words: "distance between the portion of said channel portion with".

Claim 22, column 24, line 4, delete "restricted" and substitute therefor --unrestricted--.

Claim 22, column 24, line 7, delete "to" and substitute therefor --the--.

Claim 26, line 47, delete "insufficient" and substitute therefor --sufficient--.

Claim 28, column 26, line 1, delete "a" before the word "permit" and substitute therefor --to--.

Claim 40, line 58, delete "outward to" and substitute therefor --outward wall to--.

Claim 45, column 34, line 4, delete "aid" and substitute therefor --said--.

UNITED STATES PATENT AND TRADEMARK OFFICE

CERTIFICATE OF CORRECTION

PATENT NO. : 4,775,353

DATED : October 4, 1988

INVENTOR(S) : Roger K. Childers, Kenneth L. Buchanan, Russel Darmour II

It is certified that error appears in the above-identified patent and that said Letters Patent is hereby corrected as shown below:

Claim 46, line 55, delete "of passage" and substitute therefor --for passage--.

Claim 46, line 30, delete "coins then" and substitute therefor --coins than--.

Claim 46, column 35, line 65, following "the" insert --rotating flexible surface for exit from under the head--.

Signed and Sealed this

Fourth Day of April, 1989

*Attest:*

*Attesting Officer*

DONALD J. QUIGG

*Commissioner of Patents and Trademarks*